United States Patent [19]

Hansen et al.

[11] 4,274,122

[45] Jun. 16, 1981

[54] ENERGIZING AND QUICK DEENERGIZING CIRCUIT FOR ELECTROMAGNETIC CONTACTORS OR THE LIKE

[75] Inventors: James E. Hansen, Oak Creek; Jerome G. Heinz, Milwaukee, both of Wis.

[73] Assignee: Eaton Corporation, Cleveland, Ohio

[21] Appl. No.: 50,482

[22] Filed: Jun. 20, 1979

[51] Int. Cl.[3] ..... H01H 47/32

[52] U.S. Cl. ..... 361/159; 361/13; 361/91

[58] Field of Search ..... 361/2, 8, 13, 52, 56, 361/90, 91, 101, 139, 111, 153, 159, 160, 196, 154, 209, 152, 203, 205; 137/487.5; 251/129, 131, 137, 139, 140, 141

[56] References Cited

U.S. PATENT DOCUMENTS

| | | | |
|---|---|---|---|
| 3,340,407 | 9/1967 | Sinclair . | |
| 3,378,762 | 4/1968 | Parker | 361/152 |
| 3,470,892 | 10/1969 | Barker | 251/141 X |
| 3,594,614 | 7/1971 | Halbeck . | |
| 3,737,736 | 6/1973 | Stampfli | 361/154 |
| 4,114,184 | 9/1978 | Stampfli | 361/154 |

FOREIGN PATENT DOCUMENTS

| | | | |
|---|---|---|---|
| 46-34647 | 10/1971 | Japan | 361/196 |

*Primary Examiner*—Harry E. Moose, Jr.
*Attorney, Agent, or Firm*—H. R. Rather; W. A. Autio

[57] ABSTRACT

An improved circuit for energizing and quickly deenergizing the DC operating winding of an electromagnetic relay or contactor from sources of AC supply. It employs a full wave rectifier bridge, a transistor for initiating and maintaining the energization of the relay or contactor control winding when AC is supplied to the bridge, and a zener diode connected in parallel with the main conducting path of the transistor to facilitate quick deenergization of the control winding when the AC supply to the bridge is interrupted.

6 Claims, 1 Drawing Figure

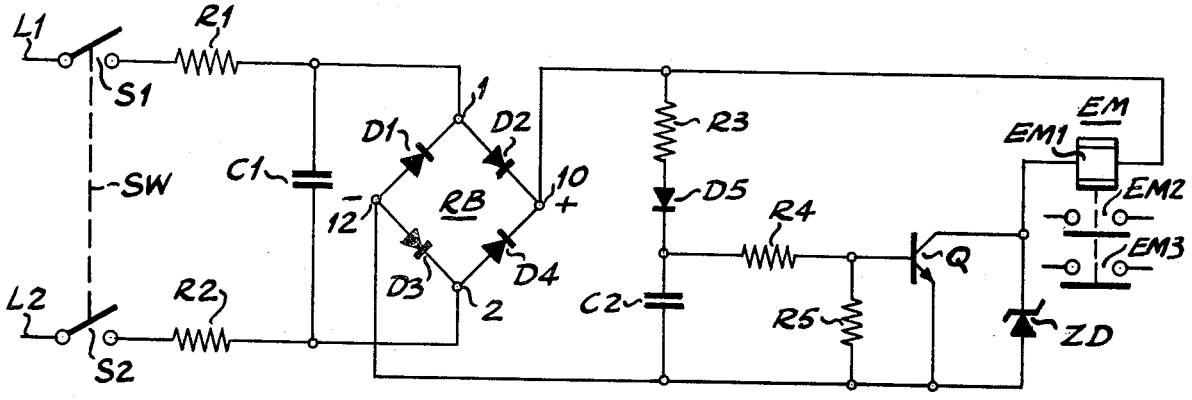
L1
R1
S1
SW
C1
D1
D2
1
10
+
12
RB
D3
D4
2
L2
R2
S2
R3
D5
R4
C2
R5
Q
EM
EM1
EM2
EM3
ZD

ENERGIZING AND QUICK DEENERGIZING CIRCUIT FOR ELECTROMAGNETIC CONTACTORS OR THE LIKE

BACKGROUND OF THE INVENTION

It is of course well known to energize the electromagnetic control windings or coils of DC relays or contactors from an AC supply source through a full wave rectifier bridge. Due to the stored energy in a coil and the presence of the rectifier bridge, such relays or contactors are slow to release when the AC supply is interrupted. As a result the action of the armature or solenoid return springs are commensurately retarded. Thus the normal accelerating forces provided by such springs are damped resulting in slow opening of the relay or contactor contacts. As a consequence arc imparted burning and erosion of such contacts occurs limiting their useful life.

The Halbeck et al U.S. Pat. No. 3,594,614 assigned to the assignee of the present application discloses one expedient that has been devised to overcome such slow to release action of DC relays or contactors fed from an AC supply source through a full wave rectifier bridge. While generally satisfactory that expedient requires the use of an additional auxiliary DC relay which adds cost and weight.

It is a primary object of the present invention to provide an improved circuit for energizing and deenergizing the DC control winding of a relay or contactor from a source of AC supply which eliminates the need for auxiliary relays and the like.

A further object is to provide a circuit of the aforementioned type which employs solid state devices to control the energization and deenergization of such relays or contactors in a manner insuring comparatively rapid deenergization upon interruption of the AC supply to the rectifier bridge.

Other objects and advantages of the invention will hereinafter appear.

BRIEF DESCRIPTION OF THE DRAWING

The single drawing FIGURE schematically depicts an improved circuit made in accordance with the invention for energizing and deenergizing a DC relay or contactor when supplied from an AC electrical power supply.

DESCRIPTION OF THE PREFERRED EMBODIMENT

Referring to the drawing, it shows an electromagnetic contactor or relay EM which is supplied with full wave rectified current from AC supply lines L1 and L2 through a full wave rectifier bridge RB, and a manually operable switch SW. Line L1 is connected through contacts S1 of switch SW in series with a resistor R1 to the upper AC input terminal of the rectifier bridge RB and line L2 is connected through the contacts S2 of switch SW in series with a resistor R2 to the lower AC input terminal of the bridge RB. A capacitor C1 is connected across the AC input terminal of bridge RB, and with the resistors R1 and R2 forms a known form of AC "hash" filter.

The bridge RB comprises the diodes D1 to D4. The point 10 common between the cathode terminals of diodes D2 and D4 is the positive DC output terminal, and the point 12 common between the anode terminals of diodes D1 and D3 is the DC negative return terminal of bridge RB. Terminal 10 is connected in series with the magnetic operating coil EM1 of an electromagnetic relay or contactor EM, and the collector-emitter circuit of an N-P-N transistor Q to the terminal 12. A zener diode ZD is connected at its cathode to the point common between coil EM1 and the collector of Q, and at its anode to the point common between the emitter of Q and terminal 12 of the bridge RB.

A resistor R3 is connected in series with a diode D5 and a capacitor C2 across terminal 10 and 12 of the rectifier bridge. A resistor R4 is connected between the point common between the cathode of diode D5 and the upper plate of capacitor C2 to the base of transistor Q. A resistor R5 is connected from the base of transistor Q, to the point common between the emitter of transistor Q, zener diode ZD, the lower plate of capacitor C2 and terminal 12 of rectifier bridge RB.

With lines L1 and L2 energized with alternating current and switch SW closed full wave unidirectional current pulses with flow from terminal 10 of bridge RB through coil EM1, and through the collector-emitter circuit of transistor Q, if then conducting, back to terminal 12. Such current also flows from terminal 10 through resistor R3, diode D5 and into and out of capacitor C2 back to terminal 12 to charge capacitor to a desired level of D.C. voltage. Consequently, the potential of the base of the transistor Q is biased to a value rendering the latter fully conductive.

The capacitance of C2 and resistance of resistor R4 are selected so that the bias on the base of transistor Q is maintained sufficiently high when the values of the rectified DC pulses are near zero potential so that Q will be maintained on continuously while switch SW is closed. The diode D5 acts as a blocking diode so that C2 can only discharge through resistor R4 and the base-emitter circuit of Q. The resistor R5 acts at high temperatures to return collector-to-base leakage current in transistor Q to terminal 12 to insure high temperature cut-off.

When coil EM1 is energized the contacts EM2 and EM3 will be closed. Now when the switch SW is opened current ceases to flow from terminal 10. Consequently, capacitor C2 quickly discharges to a value that causes transistor Q to be rendered non conducting. Due to the electromagnetic energy stored in coil EM1 current will continue to flow from such coil towards terminal 12. As transistor Q is then non conducting the stored energy current then flows through zener diode ZD, to terminal 12, and then through diodes D3 and D4, out of terminal 10 to the right hand terminal of coil EM1. Such stored energy is then rapidly dissipated by the zener diode until the potential falls below a value capable of sustaining zener conduction.

Relay EM is thus quickly deenergized to reopen its contacts EM2 and EM3. As will be understood the rate of discharge will be somewhat less than if coil EM1 were directly disconnected from terminals 10 and 12, but will be sufficiently rapid to markedly reduce the drop out time of relay EM thereby reducing arc burning and erosion at contacts EM2 and EM3.

Should there be a failure in transistor Q the most probable failure would be thermal runaway or collector to emitter shorting which would result in a continuous "on" condition. This will insure that coil EM1 would be energized whenever switch SW is closed regardless of temporary or permanent malfunctioning of the transistor Q.

The circuitry of the present invention has been used with AC frequencies as low as 60 Hz and as high as 400 Hz. It will be understood that the R-C values of resistors R3 and R4 and capacitor C2 will have to be adjusted in accordance with the frequency of the applied AC potential.

We claim:

1. In combination, a full wave rectifier bridge having input terminals for connection to and disconnection from a source of alternating potential, an electromagnetic device having a control coil, and means including a first solid state device connected in circuit with the control coil of said electromagnetic device across the DC output terminals of said rectifier bridge for energizing said operating coil with unidirectional current only when AC potential is applied to the input terminals of said rectifier bridge and a second solid state device connected in parallel with the main current conducting circuit of said first solid state device which is rendered active when alternating potential to the rectifier bridge is disconnected to provide rapid discharge circuit for said control coil inclusive of portions of said rectifier bridge.

2. The combination according to claim 1 wherein said first solid state device is a transistor which has collector-emitter circuit connected in series with said control coil across the DC output terminals of said rectifier bridge.

3. The combination according to claim 2 wherein said means additionally includes a resistor voltage divider connected between the positive output terminal of said rectifier bridge and the base of said transistor, and further includes a capacitor connected between the low potential output terminal of said rectifier bridge and an intermedidate point on said voltage divider.

4. The combination according to claim 2 wherein said second solid state device is a zener diode which is connected in series with said control coil in parallel with the collector-emitter circuit of said transistor and with its anode connected to the low output potential terminal of said rectifier bridge.

5. The combination according to claim 3 wherein said resistor voltage divider comprises two resistors and a blocking diode connected therebetween and wherein said capacitor is connected to the point common between the cathode of said blocking diode and the resistor that has connection to the base of said transistor.

6. The combination according to claim 2 and further comprising a pair of resistors connected in series between the high potential output terminal of said rectifier bridge and the base of said transistor with a blocking diode connected between said resistors, a capacitor connected between the point common between the cathode of said blocking diode and the low potential output terminal of said rectifier, and a zener diode connected in series with said control coil and the collector-emitter circuit of said transistor with its anode connected to the low potential output terminal of said rectifier bridge.

* * * * *